US008387488B2

(12) United States Patent
Pettit

(10) Patent No.: US 8,387,488 B2
(45) Date of Patent: Mar. 5, 2013

(54) REVERSIBLE ROD TONG ASSEMBLY

(75) Inventor: John Pettit, Camarillo, CA (US)

(73) Assignee: Weatherford/Lamb, Inc., Houston, TX (US)

( * ) Notice: Subject to any disclaimer, the term of this patent is extended or adjusted under 35 U.S.C. 154(b) by 272 days.

(21) Appl. No.: 12/961,640

(22) Filed: Dec. 7, 2010

(65) Prior Publication Data

US 2012/0137833 A1 Jun. 7, 2012

(51) Int. Cl.
*E21B 19/00* (2006.01)
*B25B 13/50* (2006.01)

(52) U.S. Cl. ..... 81/57.11; 81/57.18; 81/57.33

(58) Field of Classification Search ..... 81/57.11, 81/57.15, 57.16, 57.18, 57.33, 57.34, 62, 81/63.1
See application file for complete search history.

(56) References Cited

U.S. PATENT DOCUMENTS

| | | | | |
|---|---|---|---|---|
| 3,261,241 | A | 7/1966 | Catland | |
| 4,192,206 | A | 3/1980 | Schulze-Beckinghausen | |
| 4,326,435 | A | 4/1982 | Guillot et al. | |
| 4,346,629 | A | 8/1982 | Kinzbach | |
| 4,474,088 | A | 10/1984 | Lee | |
| 4,774,860 | A | 10/1988 | Hawke | |
| 4,895,056 | A | 1/1990 | Schulze-Beckinghausen | |
| 5,044,232 | A | 9/1991 | Schulze-Beckinghausen | |
| 5,081,888 | A | 1/1992 | Schulze-Beckinghausen | |
| 5,207,128 | A | 5/1993 | Albright | |
| 5,245,877 | A | 9/1993 | Ruak | |
| 5,388,647 | A | 2/1995 | McGlothlin | |
| 5,711,382 | A | 1/1998 | Hansen et al. | |
| 5,819,604 | A | 10/1998 | Buck | |
| 5,988,299 | A | 11/1999 | Hansen et al. | |
| 6,082,224 | A | 7/2000 | McDaniels et al. | |
| 6,212,763 | B1 | 4/2001 | Newman | |
| 6,374,706 | B1 | 4/2002 | Newman | |
| 7,028,585 | B2 | 4/2006 | Pietras et al. | |
| 7,621,202 | B2 * | 11/2009 | Bouligny et al. | 81/57.18 |
| 2001/0000550 | A1 | 5/2001 | Newman | |
| 2001/0000832 | A1 | 5/2001 | Newman | |
| 2008/0185154 | A1 | 8/2008 | Holladay et al. | |
| 2010/0083796 | A1 | 4/2010 | Nelson | |
| 2010/0263495 | A1 * | 10/2010 | Webb | 81/57.33 |

OTHER PUBLICATIONS

Weatherford, "Oil Country Manufacturing," Brochure, copyright 2004-2009.

Weatherford, "Weatherford's Tong Specifications," Brochure, copyright 2005.

Weatherford, "Hydraulic Sucker Rod Tong," Manual, dated Jun. 1, 2005.

* cited by examiner

*Primary Examiner* — David B Thomas
(74) *Attorney, Agent, or Firm* — Wong, Cabello, Lutsch, Rutherford & Brucculeri, L.L.P.

(57) ABSTRACT

A rod tong assembly has inner and outer rings. The outer ring has rollers disposed about a central opening. The inner ring disposes in the outer ring and has three jaws for engaging a rod element. The outer ring is rotated clockwise to make a rod connection and is rotated counter-clockwise to break the rod connection. When rotated, the rollers pivot the opposing jaws pivot against flats of the rod element. Further rotation of the outer ring then rotates the inner ring to respectively tighten or loosen the connection. To return the assembly to its default condition, operators switch a lock disposed on the inner ring to a return condition. When the outer ring is then rotated back, the lock catches on the outer ring and allows the inner ring to rotate in the same direction as the outer ring.

30 Claims, 12 Drawing Sheets

REVERSIBLE ROD TONG ASSEMBLY

BACKGROUND

Various downhole elements used in a well have sections with ends that join together by threaded connections. In some applications, a power tong assembly is used to make up or break out the threaded connections for such elements. For example, a tubing tong is used to make up or break out the threaded connections between tubulars, such as drill pipe, tubing, casing, and the like. The tubing tong grips the external cylindrical surface of a tubular and then rotates the tubular while the other tubular to which it is connected is held stationary or rotated in the opposite direction. One particular example of a tubing tong is disclosed in US Pat. Pub. No. 2010/0083796, which is assigned to the Assignee of the present disclosure and which is incorporated herein by reference in its entirety.

Because the tubing tong grips the cylindrical surface of the tubular, the surfaces of its jaws have teeth that need to be preloaded to engage the tubular. Yet, the cylindrical surface of the tubular is essentially uniform so that closing the tong's jaws against the tubular simply involves mating a cylindrical grip surface against a uniform cylinder.

Other than tubulars, sucker rods are also used in wells and have sections with ends that join together by threaded connections. Sucker rods and their threaded connections are fundamentally different from tubulars. Notably, sucker rods are considerably smaller than the much wider tubulars. In addition, sucker rods have squares or drive heads with four flats that are used for rotating the sucker rods when making or breaking a threaded connection. These flats have square edges, which can become worn with use and can complicate the gripping of the flats.

Moreover, the threaded connection for sucker rods involves affixing a male end of one sucker rod to a male end of another sucker rod using an internally threaded connector. The squares on both sucker rods must be held to make or break the connection, and these squares can have any orientation relative to one another. By contrast, a typical tubular connection mates a male end of one tubular directly to a female end of another tubular, and both tubulars have cylindrical surfaces without any difference in alignment.

Because sucker rods and their threaded connections are fundamentally different from tubulars, a hydraulic rod tong is used to make up or break out the threaded connections between sucker rods. A typical hydraulic rod tong 10 of the prior art is shown in FIGS. 1A-1B. The rod tong 10 has a frame 20 supported by a hanger and suspension assembly 25. The frame 20 houses an outer ring gear 40 that couples by internal gearing 32 to a hydraulic motor 30 and valve components mounted on the frame 20. The other end of the frame 20 has a mouth 22 and an opening 24 that expose the outer ring gear 40. The mouth 22 can have gates 23 and can be sized for passage of sucker rod components (not shown).

An inner ring 50 fits in the outer ring gear 40 and has a pair of jaws 55*a-b* for gripping rod elements. FIGS. 2A-2B show components of this inner ring 50 in isolated detail. A body 52 holds the jaws 55*a-b* therein on hinge pins 54. Springs 56 can bias the jaws 55*a-b* in the body 52. When this inner ring 50 fits in the outer ring gear 40 as shown in FIGS. 1A-1B, opposing rollers (not shown) on the outer ring gear 40 engage the jaws 55*a-b* and can pivot them inward to engage rod elements.

As noted previously, the hydraulic rod tong 10 can be used to make up or break out connections between sucker rods. In FIG. 1B, for example, the rod tong 10 is shown relative to a connection between a first sucker rod R-1, a coupling C, and a second sucker rod R-2. Before fitting the rod tong 10 onto the rod components, operators first install the inner ring 50 in the frame 20 and rotate the gear 40 and ring 50 to an "open" position so the rod components can pass through the mouth 22 of the frame 20 to the ring's jaws 55*a-b*.

Observing the bottom square on the lower sucker rod R-2, operators guide the rod tong 10 onto the lower sucker rod R-2 so that a back-up wrench 26 slides onto the flats F of the bottom square. With the rod tong 10 pulled forward, the jaws 55*a-b* inside the inner ring 50 automatically engage flats F of the upper sucker rod R-1 above the coupling C. Operators then use a control arm 28 to activate the motor 30, and the frame's internal gearing 32 rotates the outer ring gear 40. Engaged by the gear's rollers, the jaws 55*a-b* of the inner ring 50 then grip flats F of the upper sucker rod R-1 disposed therein. The backup wrench 26 prevents rotation of the lower sucker rod R-2, while rotating of the jaws 55*a-b* of the inner ring 50 tighten or loosen the upper sucker rod R-1 and the coupling C relative to the lower sucker rod R-2.

Making and breaking the connection between sucker rods R-1, R-2 requires the jaws 55*a-b* to have a proper orientation in the rod tong 10. In current rod tongs, the inner ring 50 has to be flipped over manually to change between make and break orientations. For example, FIGS. 3A-3B show the inner ring 50 and rod tong 10 set for making up a rod connection, while FIGS. 4A-4B show the inner ring 50 and rod tong 10 set for breaking out a rod connection.

To make up a rod connection, for example, operators first manually make-up the coupling C to a hand tight position (See FIG. 1C) on the sucker rods R-1, R-2. Operators then manually back off the coupling C approximately four turns. Operators set the inner ring 50 in the make orientation in the frame 20 and position the rod tong 10 in place on the rod connection as described previously. The jaws 55*a-b* engage the flats F on the upper rod R-1, and operators activate the throttle handle 28. The outer ring gear 40 and other components in the frame 20 rotate the inner ring 50 and tighten the connection between the rods R-1, R-2 and coupling C. When done, operators remove the tong 10 to make up the next connection on a rod string.

The rod string can be deployed and used downhole according to its purposes, or operators may pull and rerun the sucker rods depending on the implementation. Either way, operators will need to break out the various rod connections along the rod sting. To do this, operators need to remove the inner ring 50 and flip its orientation in the rod tong 10 to set it for breaking out rod connections.

To remove the inner ring 50, operators align the gear 40 and ring 50 as needed in the frame 20. At this point, operators disconnect the hydraulic power to the rod tong 10. With power disconnected, operators remove the inner ring 50 using an inner ring safety tool (not shown). The tool fits down into the opening 24 and engages the inner ring 50 so operators can remove the ring 50 without having to reach inside the rod tong 10.

After removing the inner ring 50, operators detach the safety tool, turn the inner ring 50 over, and reattach the safety tool to the inner ring 50 in its reverse orientation. When components of the rod tong 10 are set, operators install the inner ring 50 with the safety tool. The opening of the outer gear 40 must point in the direction of "make" when installing the inner ring 50 for the make configuration. The opposite orientation is need for the break configuration. When in place, the inner ring 50 drops down over brake drum pins, and the ring's top surface extends below the top of the frame 20. Operators then pull back on the safety tool to remove it from the inner ring 50.

Although current rod tongs 10 may be effective, they have a number of disadvantages. As noted previously, operators may need to disconnect the hydraulic power from the rod tong 10 when making manual changes to the inner ring 50. Failure to disconnect hydraulic power can be detrimental, and the need to disconnect from the power causes time delays during operations. Additionally, the various manual steps required to change the operation of the rod tong 10 increase the complexity of the tong 10 and make operating it more difficult.

The subject matter of the present disclosure is directed to overcoming, or at least reducing the effects of, one or more of the problems set forth above.

SUMMARY

A rod tong assembly has a frame that holds an outer ring therein. A through-opening and a mouth expose this outer ring in the frame. Internally, the outer ring has a central opening with a plurality of rollers disposed thereabout. An inner ring disposes in the central opening of the outer ring. The inner ring has a central jaw and a pair of opposing jaws for engaging a rod element.

In particular, the central jaw has faces for engaging adjacent flats of a rod element square (i.e., the drive head on the end of a sucker rod). Each of the opposing jaws has a face for engaging another one of the flats of the rod element square. In this way, all four flats of the rod element are engaged.

An actuator, such as a hydraulic motor on the rod tong, rotates the outer ring in the frame using gearing or the like. When the outer ring is rotated, its rollers engage the opposing jaws on the inner ring and pivot them to engage the rod element. In particular, first rollers pivot the opposing jaws against the rod element when the outer ring rotates in a first (clockwise) direction to make up a rod connection, and second rollers pivot the opposing jaws against the rod element when the outer ring rotates in a second (counter-clockwise) direction to break out a rod connection.

To make-up a connection between rod elements, the outer ring is rotated in the first (clockwise) direction in the frame. As the outer ring rotates relative to the inner ring, the first rollers reach a first point of engagement with the opposing jaws and pivot the jaws against the flats of the rod element square. The outer ring is then rotated further (about 10-revolutions or so in some cases), and this rotation turns the inner ring and the gripped jaws to tighten the connection of the rod elements.

To return the assembly to its default position, operators switch a lock to a first return condition. The lock can include a switch disposed on the inner ring that can engage catches disposed on the outer ring. A reverse arrangement is also possible in which the lock includes a switch on the outer ring and catches on the inner ring.

Either way, the outer ring is then rotated in an opposite (counter-clockwise) direction in the frame from that used to make up the rod connection. The jaws are allowed to spring open when unengaged by the rollers. As the outer ring turns, the rollers would eventually close the jaws again. However, the switch of the lock engages a corresponding catch between the inner and outer rings. When this occurs, the inner ring rotates in the same direction as the outer ring and can return to its default position, allowing the rod tong to be removed from the joined rod connection.

To break out a rod connection between rod elements, the outer ring is rotated in a second (counter-clockwise) direction in the frame from its default position. As the outer ring rotates relative to the inner ring, the second rollers engage the opposing jaws and pivot them against the flats of the rod element square. The outer ring is then rotated further. This rotation turns the inner ring in the second direction and loosens the connection of the rod elements.

To return the assembly to its default position, operators switch the lock to a second return condition. The outer ring is then rotated in the opposite (clockwise) direction, and the switch of the lock engages another catch between the inner and outer rings. With this engagement, the inner ring rotates in the same direction as the outer ring and can return to its default position.

Each of the opposing jaws has an outside edge defining first and second cam surfaces. The first cam surface engages one of the rollers for making up a rod connection, and the second cam surface engages another one of the rollers for breaking out a rod connection. Preferably, the first and second cam surfaces each define a curvilinear surface with a protrusion on the jaw's outside edge disposed therebetween. The central jaw defines two faces for engaging adjacent flats of the rod element square, and each of the opposing jaws defines a face for engaging one of the other flats of the rod element square.

The foregoing summary is not intended to summarize each potential embodiment or every aspect of the present disclosure.

DETAILED DESCRIPTION

Figure 1A:
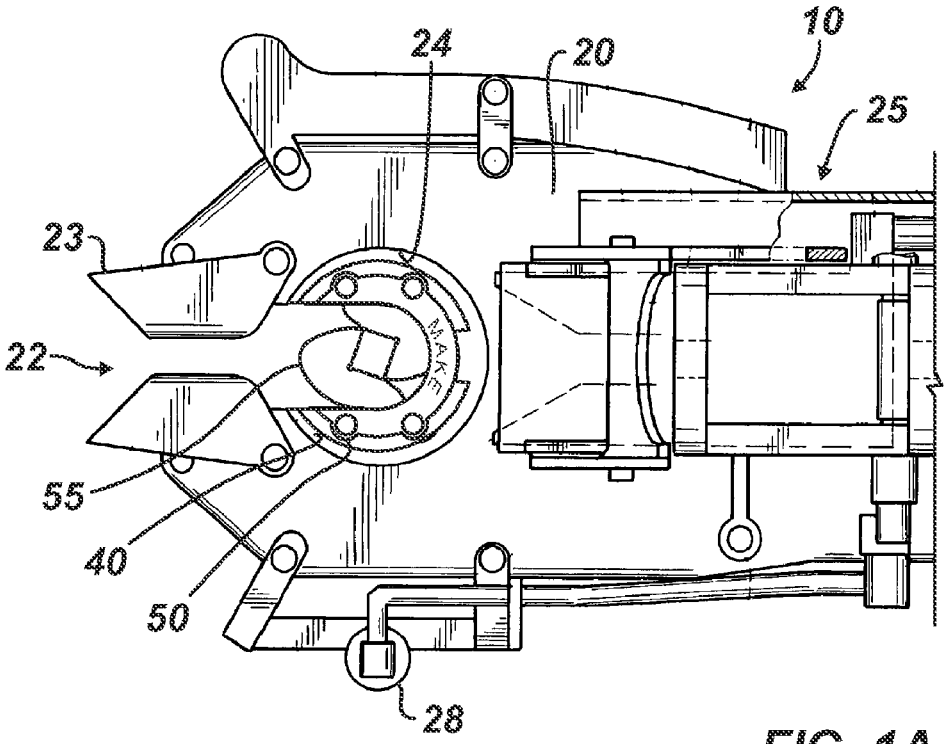
FIG. 1A (Prior Art)
FIGS. 1A-1B show a hydraulic rod tong of the prior art.
Figure 1B:
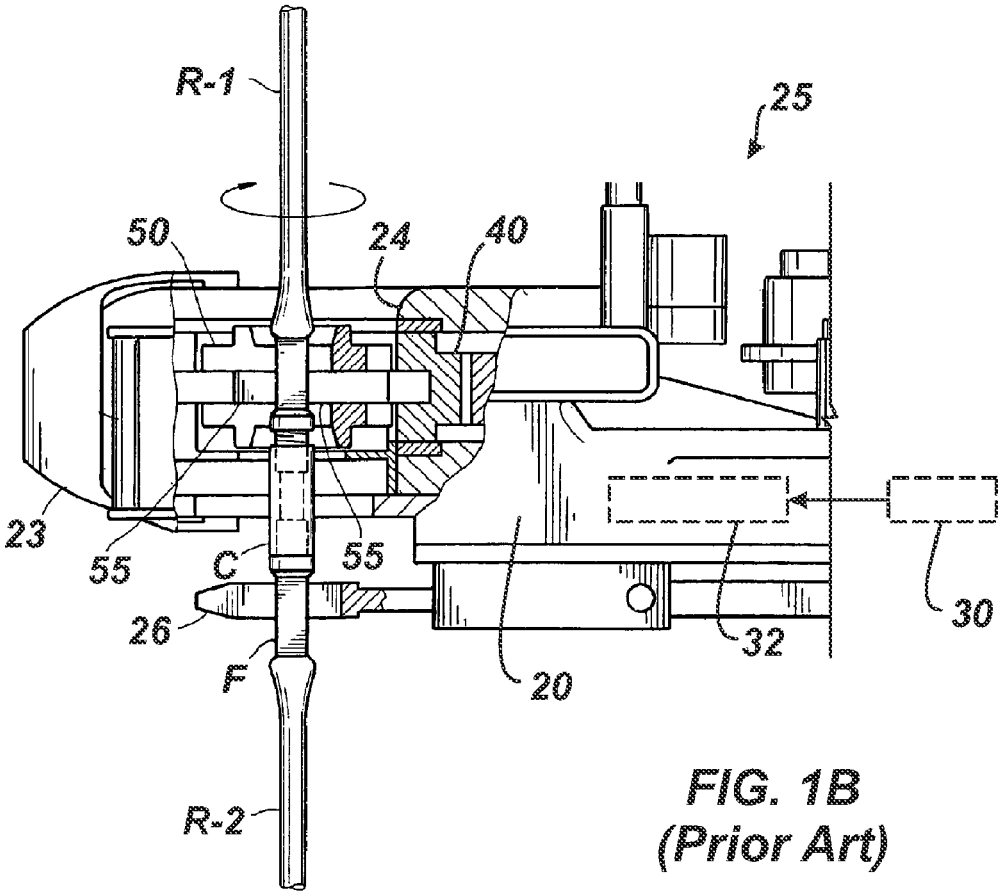
FIG. 1B (Prior Art)
Figure 2A:
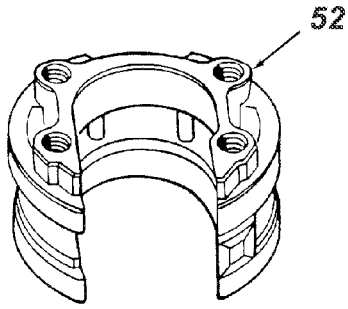
FIG. 2A (Prior Art)
FIGS. 2A-2B show components of an inner ring of the prior art.
Figure 2B:
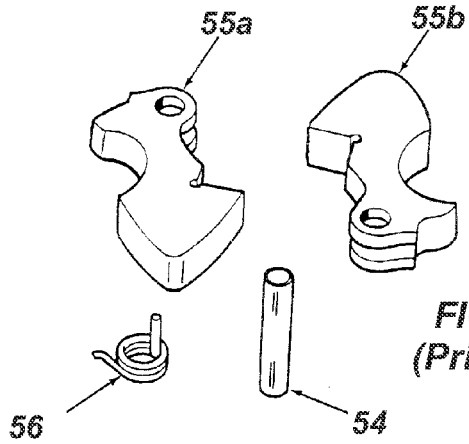
FIG. 2B (Prior Art)
Figure 3A:
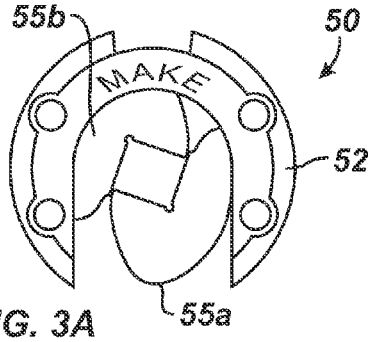
FIG. 3A (Prior Art)
FIGS. 3A-3B show the inner ring and rod tong set of the prior art set up for making up a rod connection.
Figure 4A:
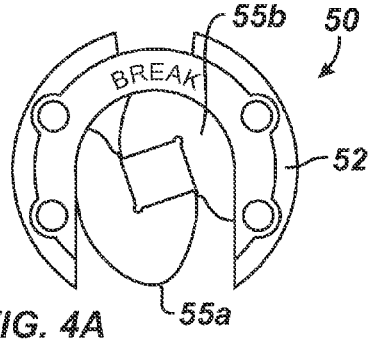
FIG. 4A (Prior Art)
FIGS. 4A-4B show the inner ring and rod tong set of the prior art set up for breaking out a rod connection.
Figure 3B:
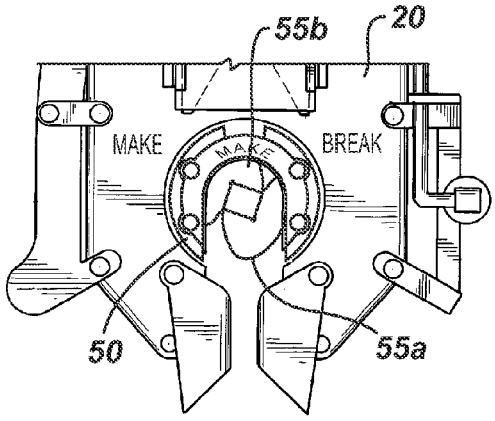
FIG. 3B (Prior Art)
Figure 4B:
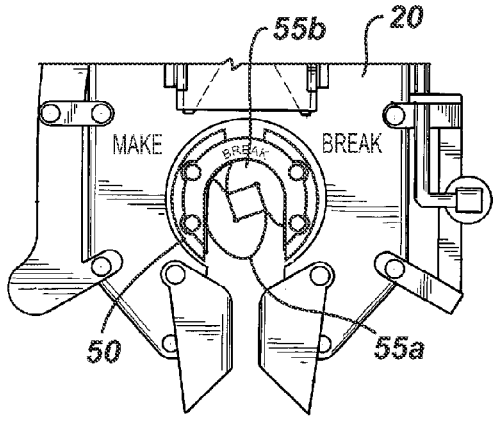
FIG. 4B (Prior Art)
Figure 5A:
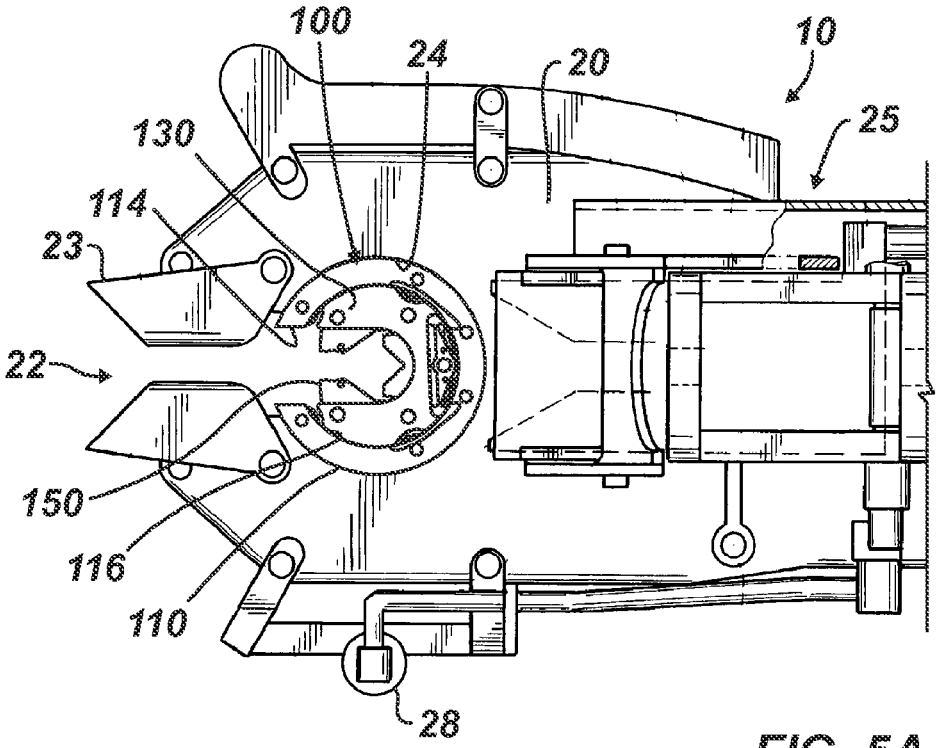
FIGS. 5A-5B show a reversible assembly of the present disclosure in a rod tong.
Figure 5B:
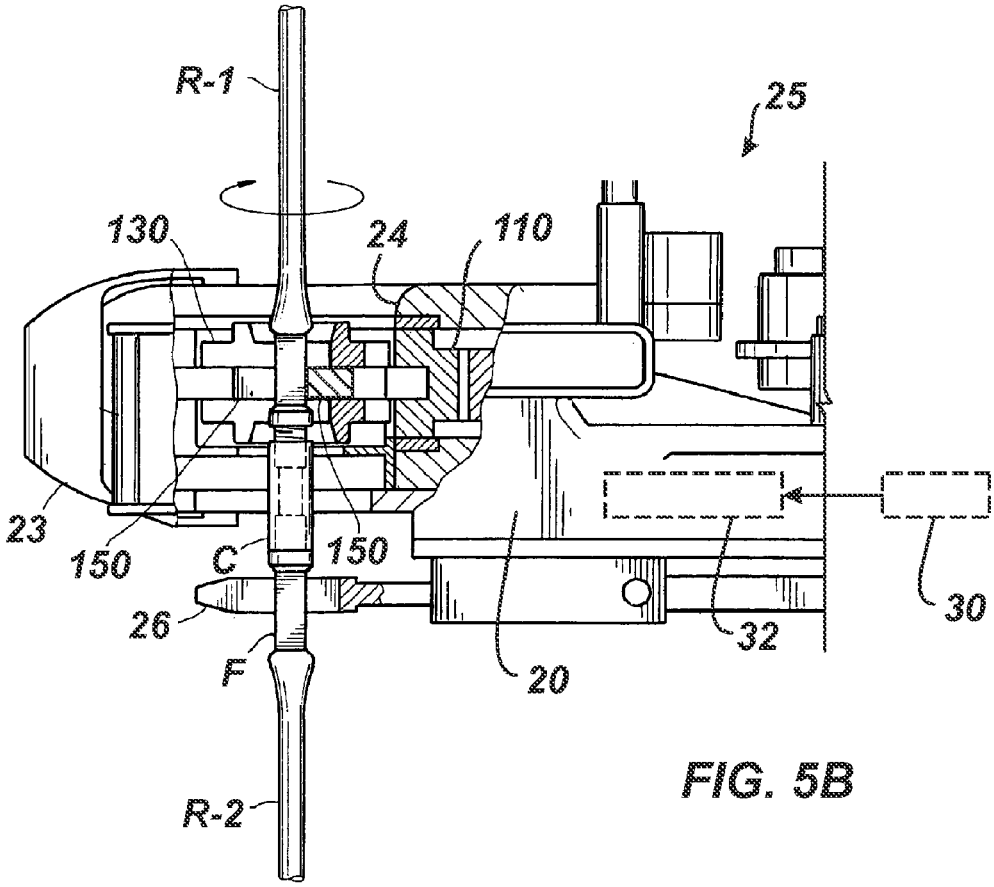

A rod tong 10 shown in FIGS. 5A-5B has a reversible assembly 100 according to the present disclosure. Although not shown in detail, the rod tong 10 can be similar to that disclosed previously. Accordingly, the rod tong 10 can have a frame 20, a hanger and suspension assembly 25, an actuator 30, internal gearing 32, and the like. As detailed below, the reversible assembly 100 can reduce rig time on a well that requires the pulling and rerunning of sucker rods. Additionally, using the reversible assembly 100, operators can avoid having to reverse an inside ring manually in the rod tong 10 to change between making and breaking rod connections.

The assembly 100 has an outer ring 110 and an inner ring 130. The outer ring 110 disposes in the frame 20 of the rod tong 10 in a manner similar to that described previously. The actuator 30 (e.g., hydraulic motor or the like) on the frame 20 mates through gearing 32 with the outer ring 110 to rotate the outer ring 110 in the frame 20. Depending on its orientation, the outer ring's side slot 114 can align with the frame's mouth 22 for passage of rod elements. All the while, the outer ring's through-passage 116 remains exposed in the frame's central opening 24.

The inner ring 130 disposes in the outer ring 110. As is typical, the outer ring 110 can be fixedly held in the tong's frame 20 being coupled to various gears 32 and braking components (not shown) known and used in rod tongs. The inner ring 130, however, is preferably removable from the rod tong 10. The removable inner ring 130 allows operators to replace or repair the inner ring 130 if needed and allows operators to use various inner rings 130 for different sizes and forms of sucker rod connections with the same rod tong 10.

The inner ring 130 has jaws 150 for engaging flats of a rod element square disposed in the inner ring 130. Engaged by the rotating outer ring 110, these jaws 150 can grip the rod element square. In addition, the inner ring 130 can rotate with the outer ring 110 to make up (tighten) or break out (loosen) the connection of rod elements.

Figure 6A:
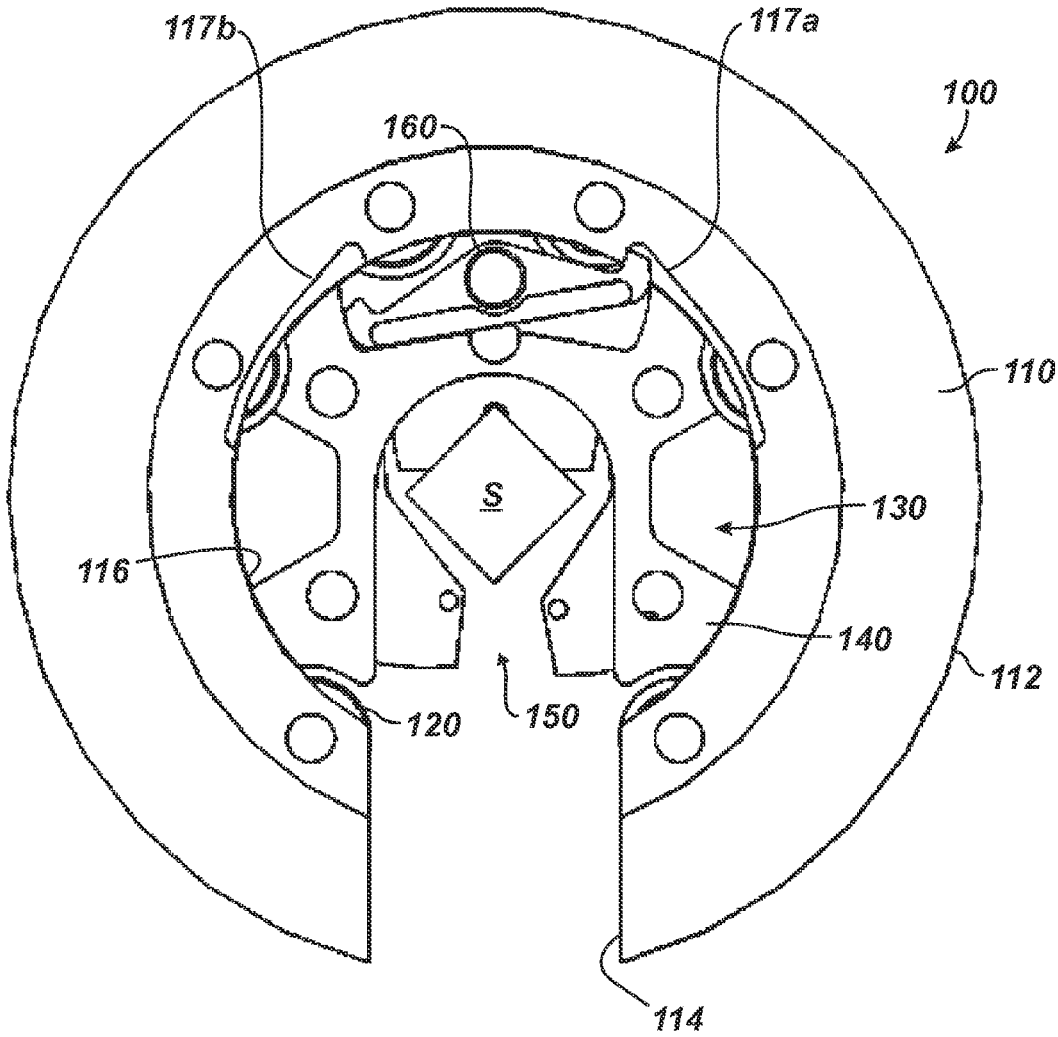
FIGS. 6A-6C show various views of the reversible assembly.
Figure 6B:
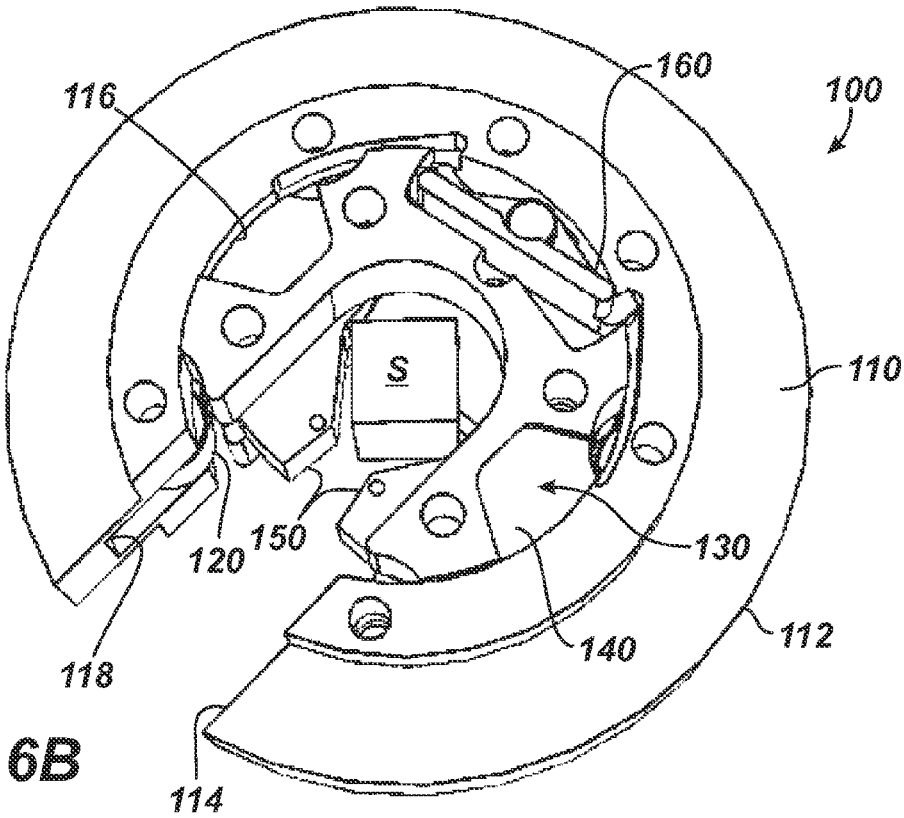
Figure 6C:
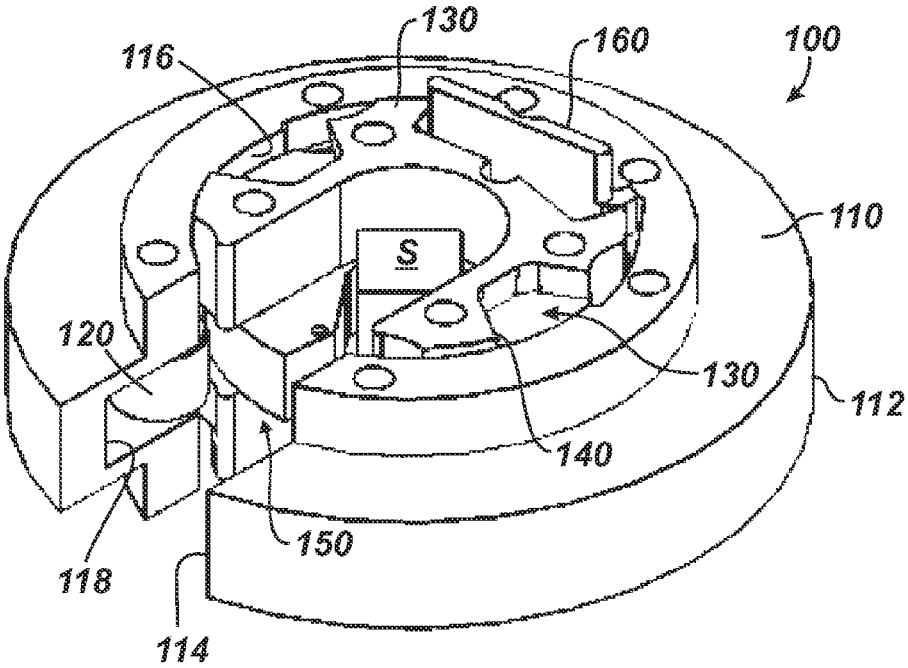

Further details of the reversible assembly 100 are shown in FIGS. 6A-6C. Being rotatable in the tong's frame (20), the outer ring 110 has a gear 112 with teeth (not shown) disposed about the ring's outer edge. As noted previously, internal gearing (32) in the tong's frame (20) engage with the teeth of the gear 112 to rotate the outer ring 110 in a manner similar to that described previously. The teeth of the gear 112 can take any desirable form.

Disposed about its through-passage 116, the outer ring 110 defines a circumferential channel 118 in which a plurality of rollers 120 position. Edges of these rollers 120 extend partially into the through-passage 116. Depending on the orientation between the rings 110 and 130, the rollers 120 can engage portions the inner ring 130 fit in the through-passage 116.

For its part, the inner ring 130 has a forked body 140 that holds the plurality of jaws 150 therein. Depending on the orientation of the inner ring 130 relative to the outer ring 110, various ones of the rollers 120 engage outer edges of the jaws 150. This forces the jaws 150 inward toward one another and tends to make the inner ring 130 rotate with the outer ring 110 as described in more detail later.

On its back edge, the forked body 140 of the inner ring 130 has a switch 160 that can engage the outer ring 110. As best shown in FIG. 6A, the inner edge of the through-passage 116 on the outer ring 110 has catches 117*a-b*. Depending on the orientation of the switch 160 and the rotation of the outer ring 110, edges on the switch 160 can engage in one of the catches 117*a-b*. This causes the inner ring 130 to rotate with the outer ring 110 without engagement by the rollers 120 as described in more detail below.

Together, the switch 160 and the catches 117*a-b* form a lock that can be selectively set between first and second return conditions. Set in one return condition, for example, the inner and outer rings 110/130 can rotate clockwise relative to one another by engagement of the rollers 120 with the jaws 150, but the switch 160 and one catch 117*a* engage to make the inner and outer rings 110/130 rotate together in the counter-clockwise direction. Likewise, set in the other return condition by engagement of the rollers 120 with the jaws 150, the inner and outer rings 110/130 can rotate counter-clockwise relative to one another, but the switch 160 and the other catch 117*b* engage to make the inner and outer rings 110/130 rotate together in the counter-clockwise direction.

Although the lock has the switch 160 disposed on the inner ring 130 and has the catches 117*a-b* disposed on the outer ring 110, a reverse arrangement can be used. In other words, a switch (160) can be disposed on the outer ring 110 and can engage corresponding catches (117*a-d*) on the inner ring 130. As opposed to the rotating switch 160 and catches 117*a-b*, other forms of lock mechanisms can be used on the reversible assembly 100. For example, the inner and outer rings can use a pin and slot arrangement or other suitable mechanism.

Figure 7A:
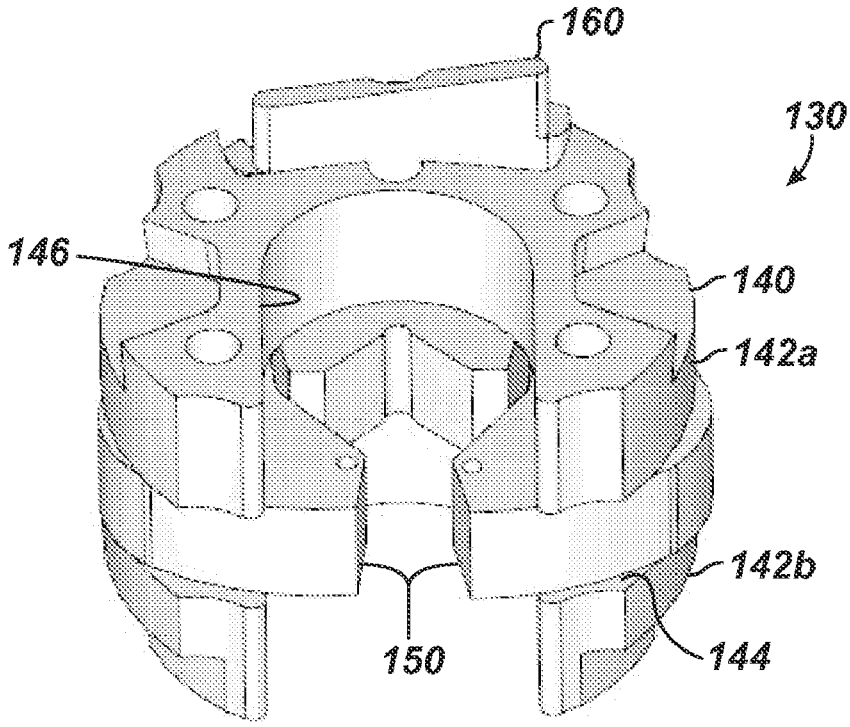
FIGS. 7A-7B show front and back perspective views of an inner ring for the reversible assembly.
Figure 7B:
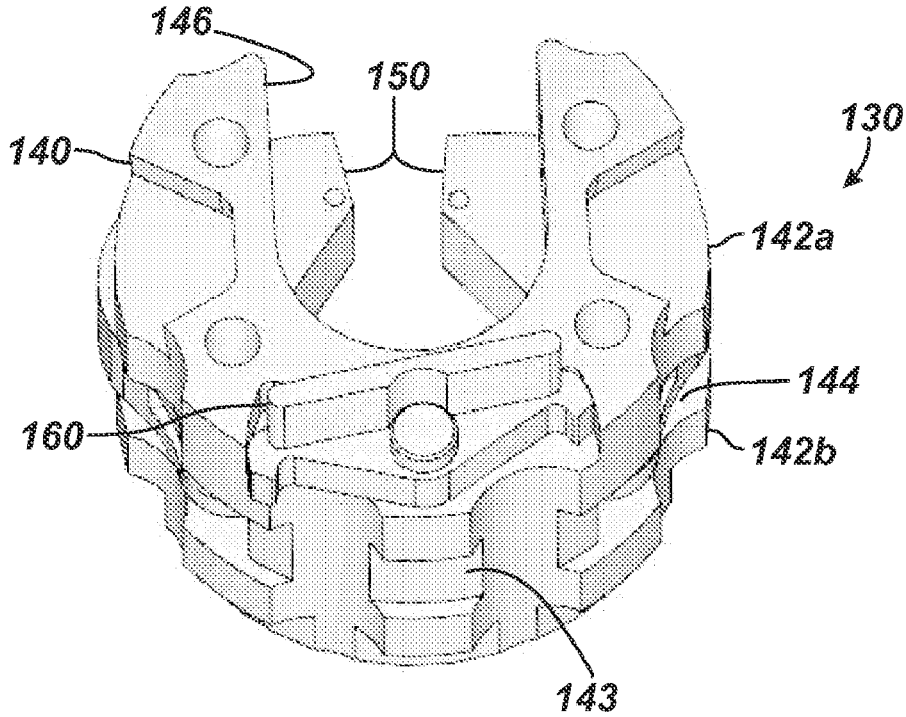
Figure 8A:
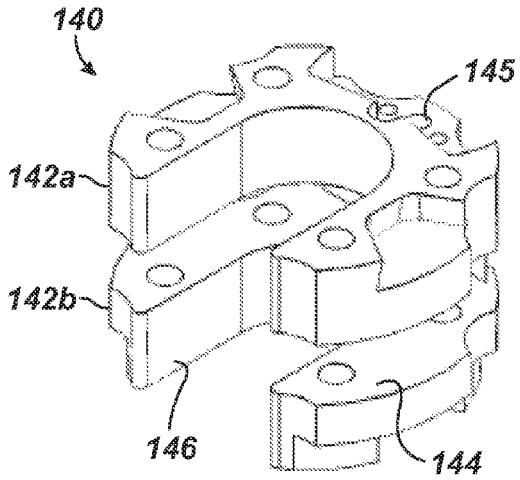
FIGS. 8A-8B show the body of the inner ring.
Figure 8B:
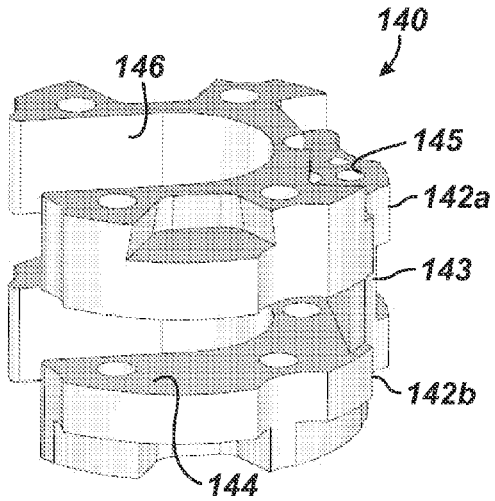

Before discussing the operation of the reversible assembly 100 in more detail, discussion first turns to details of various components of the assembly 100. FIGS. 7A-7B show the inner ring 130 for the reversible assembly 100 in isolated detail, while FIGS. 8A-8B show the forked body 140 of the inner ring 130 in isolated detail. The forked body 140 has upper and lower forks 142*a-b* separated by a gap 144 and connected by a back edge 143. Each of the forks 142*a-b* defines a side slot 146 for passage of rod elements. The jaws 150 fit into the gap 144 between the forks 142*a-b* and are exposed in the forks' side slots 146.

Figure 8C:
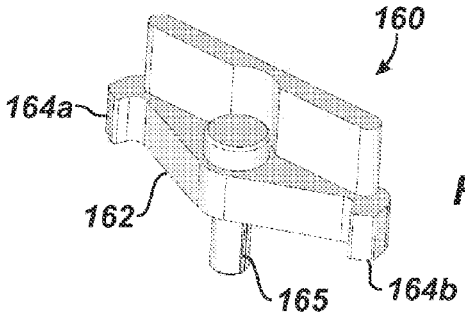
FIG. 8C shows the switch for the inner ring.

FIG. 8C shows the switch 160 for the inner ring 130. The switch 160 has a body 162 with opposing hooks or catches 164*a-b* and a central pin 165. The central pin 165 fits into a rear slot 145 on the inner ring's forked body 140 as shown in FIGS. 8A-8B. The switch's body 162 can pivot on the central pin 165 so either of the opposing hooks 164*a-b* can be switched beyond the edge of the forked body 140.

Figure 9:
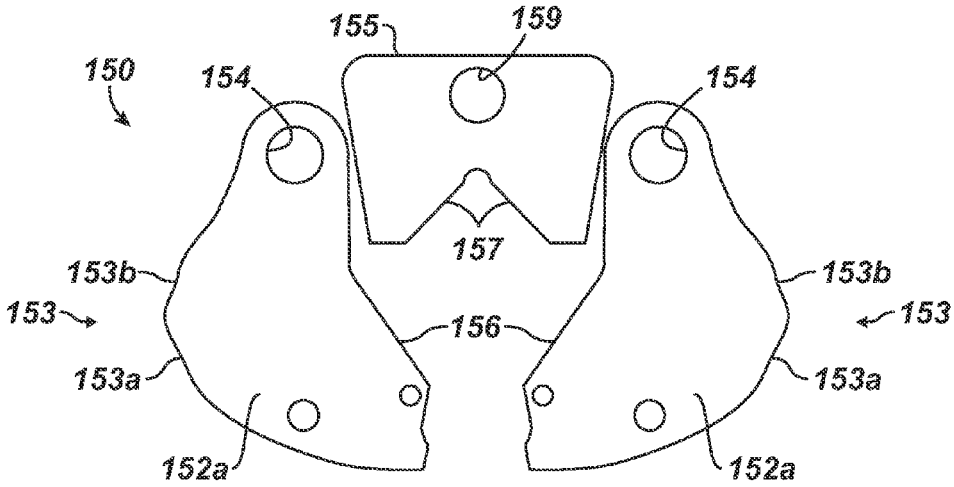
FIG. 9 shows a plan view of the jaws of the inner ring.
Figure 10A:
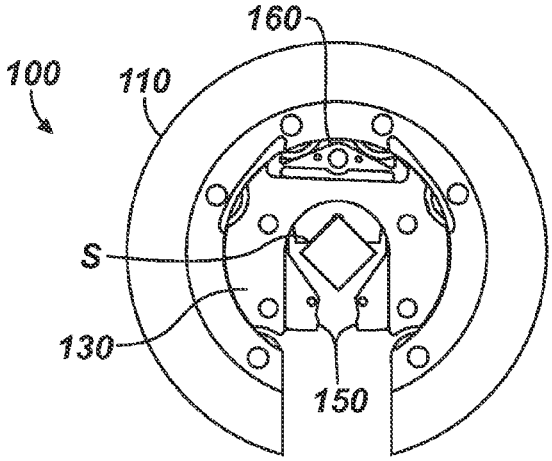
FIGS. 10A through 12B show the reversible assembly in a make-up operation.
Figure 10B:
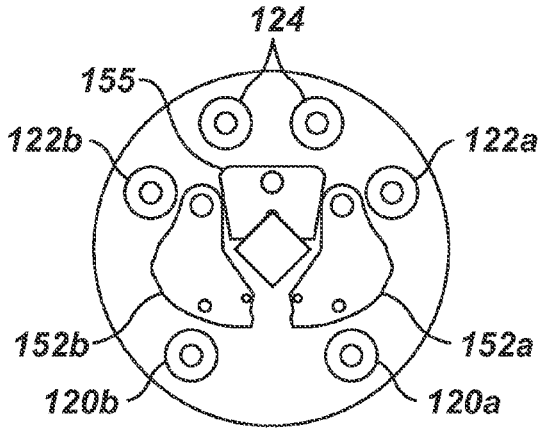

FIG. 9 shows the jaws 150 of the inner ring 130 in isolated detail. The jaws 150 include first and second pivoting jaws 152*a-b* and a fixed jaw 155. The pivoting jaws 152*a-b* each have a pivot point 154 for a pivot pin (not shown) on which the jaw 152*a-b* can pivot. The pivot pins are held in the forks 142*a-b* of the forked body 140 shown in FIGS. 8A-8B. Springs (not shown), such as torsion springs or the like, can be disposed on these pivot pins to bias the jaws 152*a-b* open or closed from one another.

The fixed jaw 155 has a rectilinear socket surface 157 to engage adjacent flats of a rod element square as discussed later. When disposed in the forked body (140), the fixed jaw 155 remains fixed, although it may be able to shift about a pin (not shown) disposed in hole 159 that holds the jaw 155 in the forked body (140). For their part, each of the pivoting jaws 152*a-b* has a socket surface 156 to engage a flat of the rod element square as discussed later.

In addition, each of the pivoting jaws 152*a-b* has a cam 153 on its outer edge for engaging the rollers (120) of the outer ring (110) as discussed later. The cams 153 can be profiled with cam sections 153*a-b*. Overall, the cams 153 produce a mechanical advantage so that the jaws 152*a-b* and 155 are expected to still grip a rod element square even if the flats are worn.

With an understanding of the various components of the reversible assembly 100 provided above, discussion now turns to the operation of the assembly 100 for making and breaking connections between rod elements.

Figure 11A:
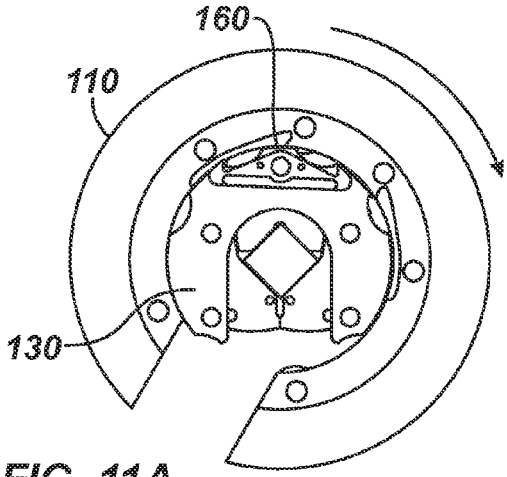
Figure 11B:
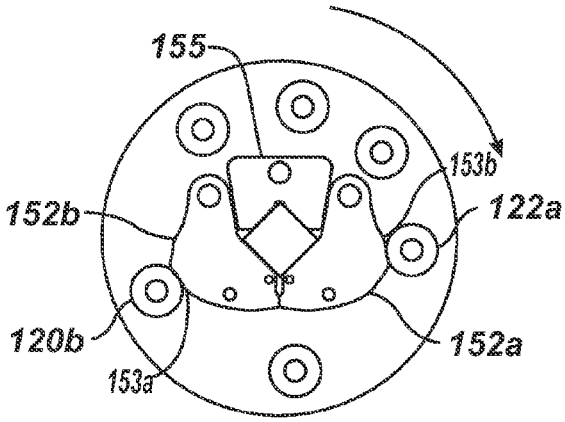
Figure 12A:
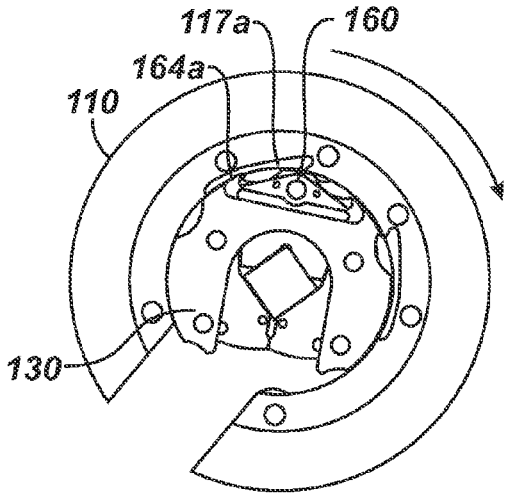
Figure 12B:
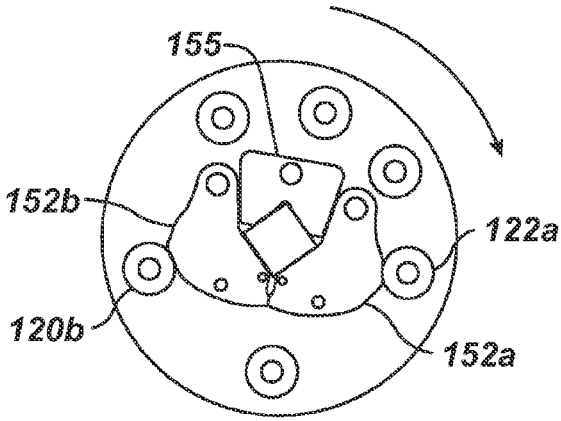

FIGS. 10A through 12B show the reversible assembly 100 in different stages for making a rod connection. In FIGS. 10B, 11B, and 12B, the outer ring 110 is only conceptually shown so that the arrangement of rollers 120 can be seen relative to the jaws 152*a-b*, 155. In an aligned condition shown in FIG. 10A-10B, the pivoting jaws 152*a-b* remain unengaged by any rollers 120. Therefore, the bias of springs for these jaws

152*a-b* may tend to move them apart. This condition allows the rod element to pass between the jaws 152*a-b* through the various side slots of the inner ring 130, outer ring 110, and frame (not shown).

To make up a rod connection, operators perform various steps as detailed previously. For example, operators manually tighten and back off the connection of the sucker rods R-1 and R-2 and the coupling C as in FIG. 5B, for example. The inner and outer rings 110, 130 are aligned in their default position in the rod tong 10, and operators position the rod tong 10 on the rod connection. As before, the backup wrench 26 on the rod tong 10 engages the flats F of the lower sucker rod R-2 below the coupling C, while the flats F of the upper sucker rod R-1 pass through the inner ring 130 disposed in the outer ring 110 on the rod tong 10.

Using the hydraulic actuator 30 and gearing 32 of the rod tong 10, operators activate the rod tong 10 to make up the rod connection. The outer ring 110 rotates clockwise in the rod tong's frame as shown in FIGS. 11A-11B. A back roller 122*a* engages the inner cam section 153*b* of one pivoting jaw 152*a*, while a front roller 120*b* engages the opposing cam section 153*a* of the other pivoting jaw 152*b*. This tends to force the pivoting jaws 152*a-b* toward one another to engage the flats of the rod element square S (i.e., the drive head of upper rod R-1 in FIG. 5B) and tends to force the rod element square S against the fixed jaw 155.

Continued clockwise rotation further forces the jaws 152*a-b* together and toward the fixed jaw 155 as shown in FIGS. 12A-12B. The rear rollers 124 on the outer ring 110 stabilize the inner ring 130 during rotation by engaging in between the gap (144) on the inner ring's forked body (See e.g., FIGS. 8A-8B). In the end, the fixed engagement between the rollers 120*b*, 122*a* and jaws 152*a-b* causes the jaws 150 (and connected inner ring 130) to rotate with the outer ring 110. In this orientation, the clockwise rotation can make or thread together rod elements. Typically, the rings 110/130 are rotated a number of revolutions (10 or so) until the rod elements shoulder out. Then, hydraulic pressure is built up with the rod tong so a desired amount of torque can be applied to complete the rod connection.

To return the inner and outer rings 110/130 to their aligned condition, operators rotate the outer ring 110 counter-clockwise. This moves the rollers 120 from the jaws 152*a-b*, allowing them to spring open away from the rod element square S. If allowed to continue rotating, the rollers 120 would eventually engage the jaws 152*a-b* again. To prevent this, the switch 160 on the inner ring 130 is switched so that its hook 164*a* will engage in the catch 117*a* as the outer ring 110 is rotated counter-clockwise from its position in FIG. 12A back to its position in FIG. 10A. This engagement of the hook 164*a* and catch 117*a* makes the inner ring 130 rotate with the outer ring 110 so the inner ring 130 can return to the aligned condition of FIG. 10A.

Breaking out a rod connection involves the reverse of the steps described previously. FIGS. 13A through 15B show the reversible assembly 100 in different stages for breaking out a rod connection. The operation starts with the aligned condition shown in FIGS. 13A-13B. Operators rotate the outer ring 110 counter-clockwise in the rod tong's frame as shown in FIGS. 14A-14B. A back roller 122*b* engages the inner cam section 153*b* of one pivoting jaw 152*b*, while a front roller 120*a* engages the opposing cam section 153*a* of the other pivoting jaw 152*a*. This tends to force the pivoting jaws 152*a-b* toward one another to engage the rod element square S and tends to force the rod element square S against the fixed jaw 155.

Figure 15A:
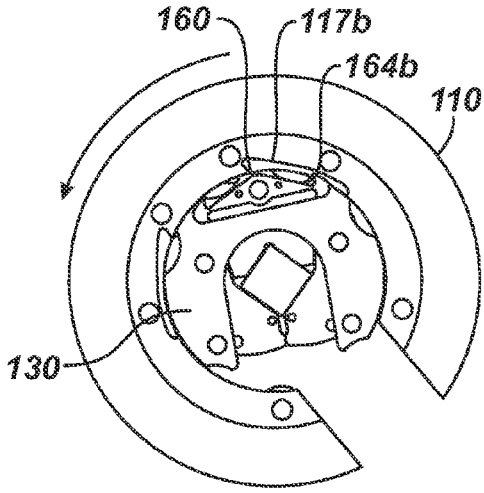
Figure 15B:
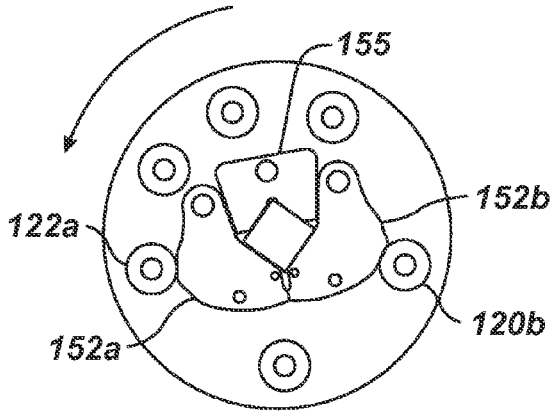

Continued counter-clockwise rotation further forces the jaws 152*a-b* together and toward the fixed jaw 155 as shown in FIGS. 15A-15B. In the end, the fixed engagement causes the jaws 150 (and connected inner ring 140) to rotate with the outer ring 110. In this orientation, the counter-clockwise rotation can break out or unthread components of the rod elements.

Figure 13A:
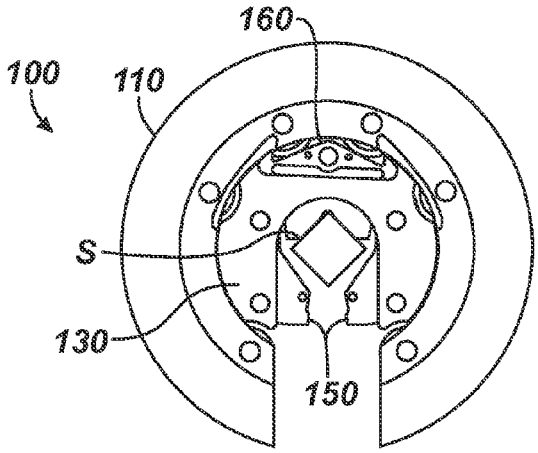
FIGS. 13A through 15B show the reversible assembly in a break-out operation.
Figure 13B:
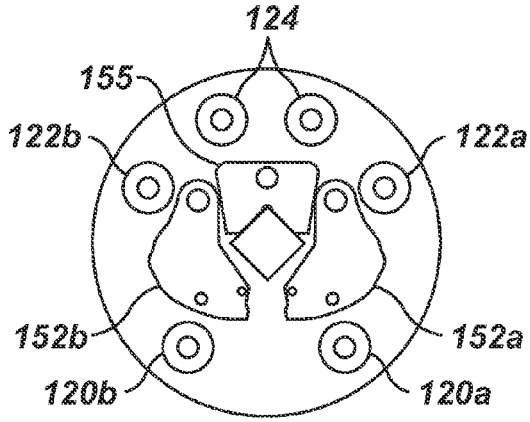
Figure 14A:
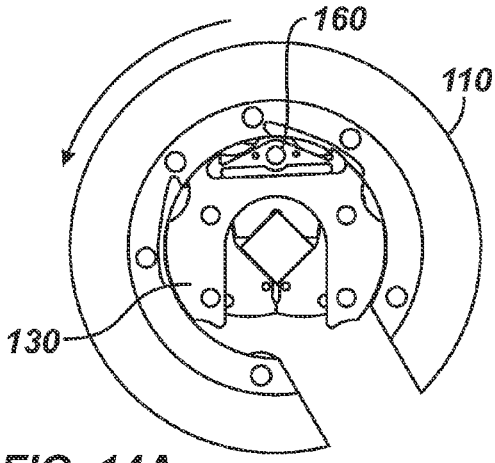
Figure 14B:
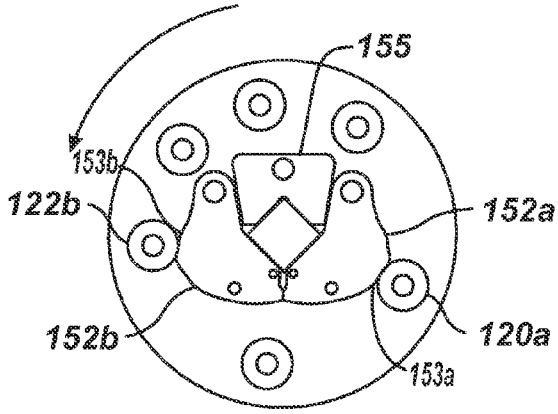

To return the inner and outer rings 110/130 to their aligned condition, the switch 160 on the inner ring 130 is switched so that its hook 164*b* will engage in the catch 117*b* as the outer ring 110 is rotated clockwise from its position in FIG. 15A to its position in FIG. 13A. This engagement makes the inner ring 130 rotate with the outer ring 110 so the inner ring 130 can return to the aligned condition of FIG. 13A.

As noted above, the inner ring 130 is removable from the outer ring 110, and the forked body 140 can hold jaws 150 for different sized rod element squares S. Sizing for the fixed jaw 155 can be straightforward for different sized rod element squares S. However, because the pivoting jaws 152*a-b* pivot, they can have different dimensions for use with different sized rod element squares S.

Figure 16A:
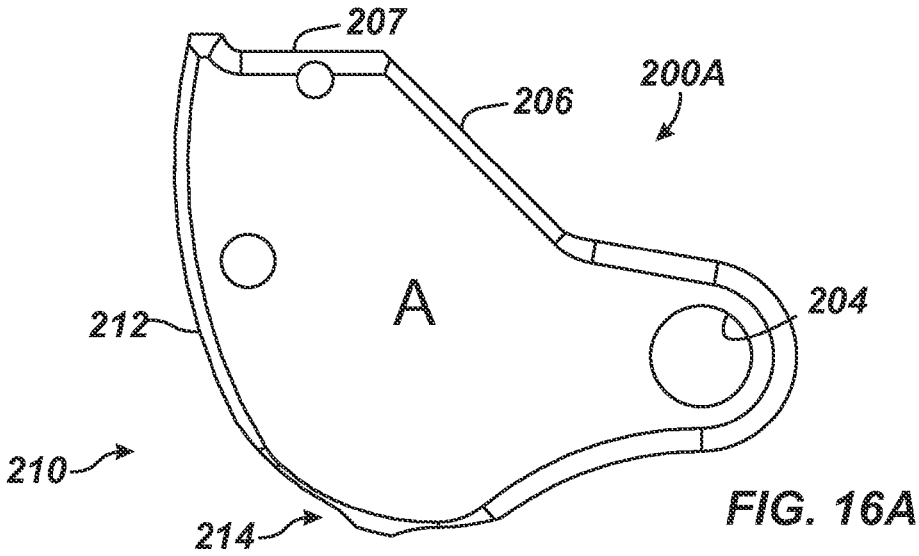
FIGS. 16A-16C and 17 show different pivoting jaws for the disclosed reversible assembly.
Figure 16B:
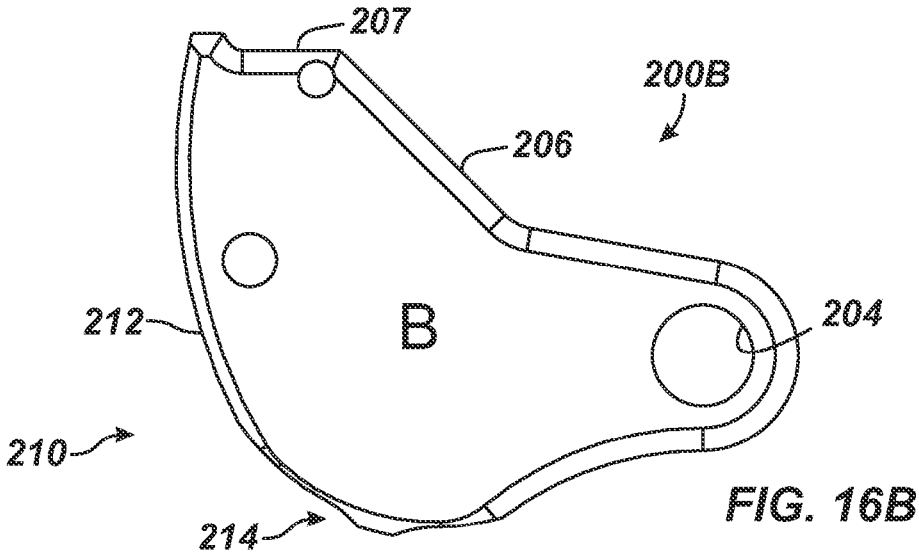
Figure 16C:
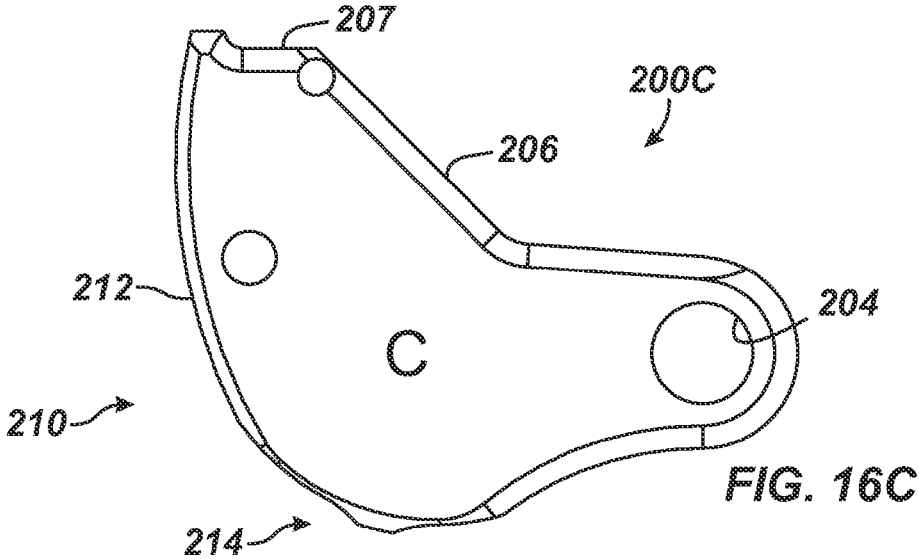
Figure 17:
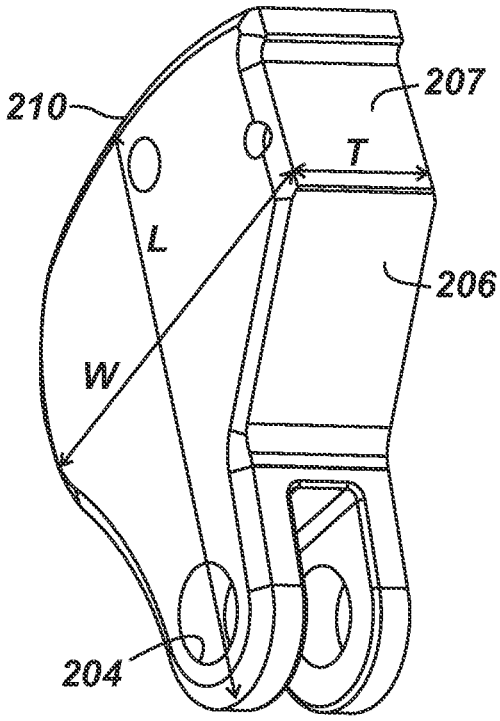

For reference, FIGS. 16A-16C and 17 show different pivoting jaws 200 for the disclosed reversible assembly. Each of the jaws 200 has a pivot point 204 for passage of a hinge pin (not shown). As best shown in FIG. 17, the pivot point 204 is forked so a spring (not shown) can dispose on the hinge pin passing therethrough to bias the jaw 200. Each jaw 200 also has an outer cam 210 and an inner socket surface 206. Each of the outer cams 210 has a cam surface 212 and a cam profile 214 described in more detail later. Finally, each jaw 200 has a head 207.

Each different sized jaw 200A-C in FIGS. 16A-16C can be machined and hardened from a single cast jaw and can be configured for different sized rod elements. For example, the jaw 200A in FIG. 16A can be sized for rod elements of ¾" to ⅞", the jaw 200B in FIG. 16B can be sized for 1", and the jaw 200C in FIG. 16C can be sized for 1⅛".

Overall dimensions of the jaws 200A-C are the same for each of the different sizes. For example, the thickness T of the jaw 200 as shown in FIG. 17 can be about 1" for each size, and the overall length L of about 3.31" and width W of about 2.68" can be the same for the various sized jaws 200. However, the orientation of the socket surface 206 changes between sizes relative to the pivot point 204, and the length of the head 207 also varies between sizes. The various dimensions provided above are meant to be exemplary. Actual dimensions will depend on the implementation and the desired size of the jaw 200, type of rod element, and other factors for a given implementation.

Figure 18:
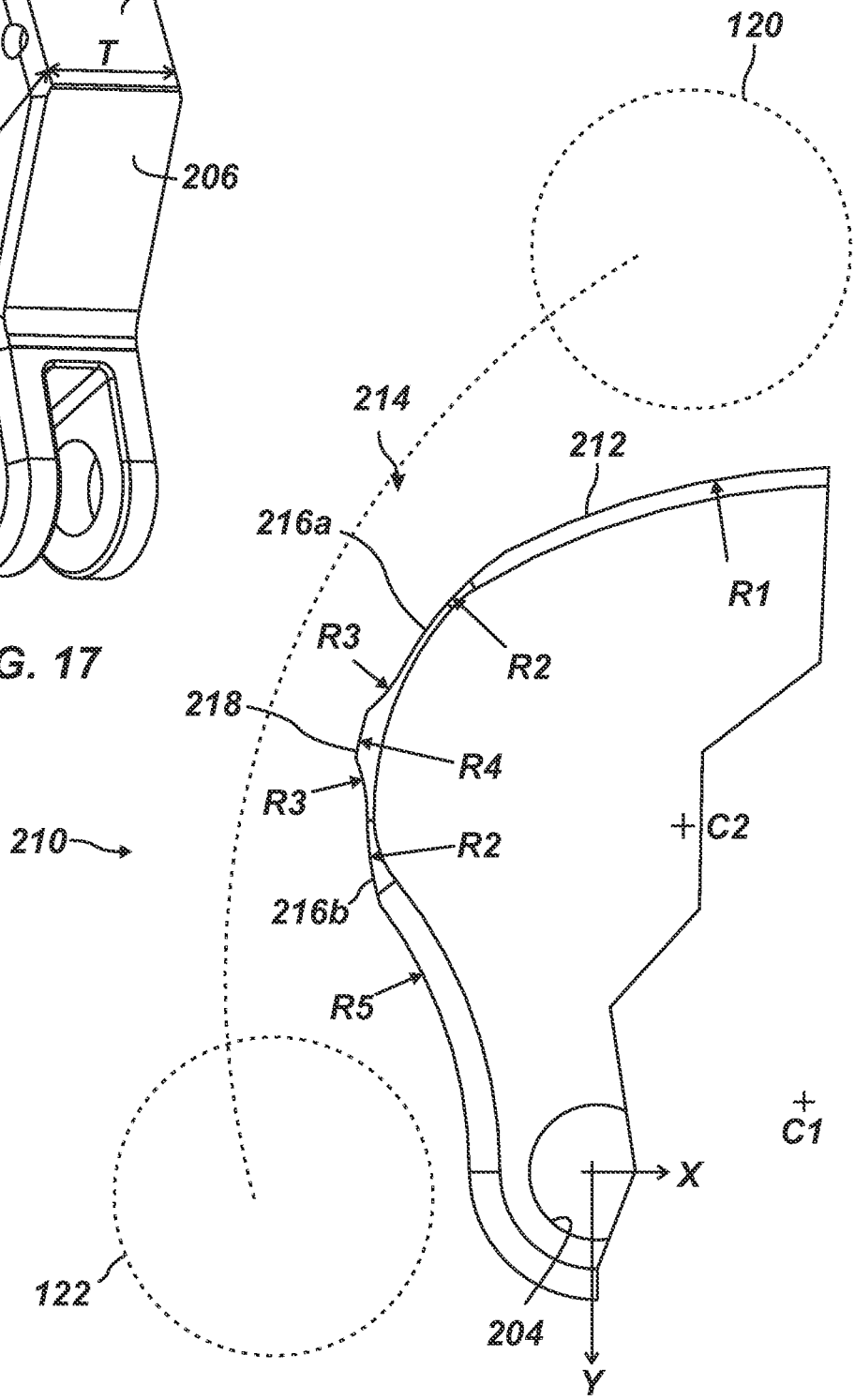
FIG. 18 shows the cam of the pivoting jaw in more detail.

As with the dimensions, the cams 210 of the various jaws 200A-C are the same for each of the different sizes. FIG. 18 shows the cams 210 for the pivoting jaw 200 in more detail relative to two of the outer ring's rollers 120/122 (schematically depicted). Notably, an inner radius R1 for a cam surface 212 measured from an offset center C1 is the same for each sized jaw 200. This radius R1 is set to engage one of the front rollers 120 when rotated thereto.

For its part, the cam profile 214 is symmetrical and is similarly situated on each sized jaw 200. Overall, the cam profile 214 produces a mechanical advantage so that the jaw 200 is expected to still grip a rod element square even if the flats are worn. As shown, the cam profile 214 extends off the cam surface's radius R1 and includes a first cam section 216*a*, an intermediate protrusion 218, and a second cam section 216*b*. The cam sections 216*a-b* are mirror images of one another.

As disclosed herein, the front roller 120 engages the first cam section 216*a* when rotated thereto, and the back roller 122 engages the second cam section 216*b* when rotated thereto. Both of the rollers 120/122 can nest against the intermediate protrusion 218. Each cam section 216*a-b* defines an inner radius R2 measured from a center C2 on the jaw 100 and defines an outer radius R3 that transitions to the protrusion 218, which extends an increased inner radius R4 from the jaw's center C2.

Some exemplary dimensions are provided for illustrative purposes. If the pivot point 204 defines X-Y coordinates, the center C1 can be at coordinates of 0.188", 1.0", while the center C2 can be at coordinates of −1.4", 0.350" regardless of the jaw size. The radius R1 for the cam surface 212 can be about 2.95", while the radius R2 for the cam sections 216*a-b* can be about 1.25". The protrusion's radius R4 can be a little greater, and the outer radii R3 can essentially be the same as the rollers 120/122. From the profile 214, the outer edge of the jaw 200 towards the pivot 204 defines a large inverse radius R5—a portion of which the roller 122 may engage if the jaw 200 is overly opened. Actual dimensions will depend on the implementation and the desired size of the jaw 200, type of rod element, and other factors.

Figure 19:
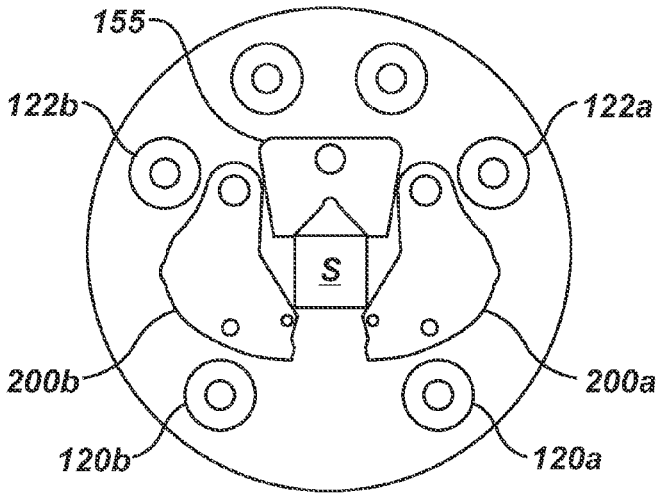
FIG. 19 shows an example of the disclosed pivoting jaws and central jaw relative to a rod element square.

As shown again in FIG. 19, the reversible assembly 100 uses the two opposing jaws 200*a-b* such as disclosed above and the center jaw 155 to engage the square S of a sucker rod as noted herein. Bringing the adjacent socket surfaces 157 of the center jaw 155 and the complementary socket surfaces 206 of the opposing jaws 200*a-b* against the flats of the rod's square S must be able to handle situations where the square S is not aligned with the surfaces 206/157. In other words, as opposed to simply engaging a cylindrical surface as with a tubing tong, the socket surfaces 206/157 of the rod tong jaws 200/155 must engage the rod's square S if not aligned and even if the square's edges are oriented toward the surfaces 206/157.

Figure 20:
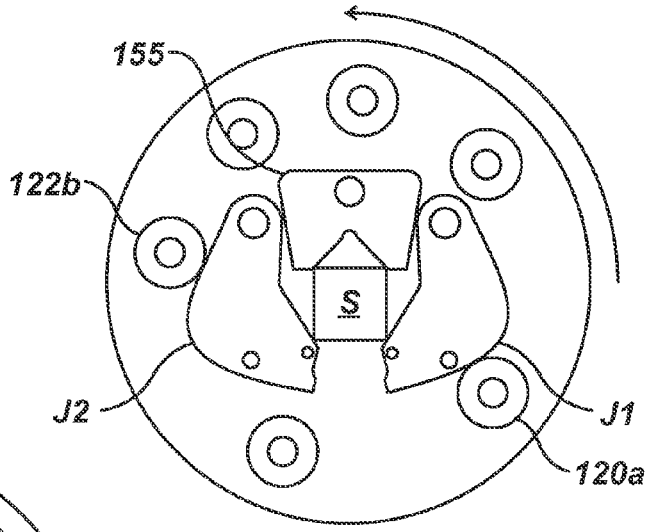
FIG. 20 shows an example of arbitrary jaws engaging edges of the rod element square during rotation.

In some circumstances, for example, the surfaces 206/157 of the jaws 200/155 may close on the square's edges as depicted in FIG. 19. For comparison to the disclosed jaws 200*a-b*, FIG. 20 show arbitrary jaws J1/J2 for engaging a rod element square S. Simply engaging the arbitrary jaws J1/J2 with the rollers 120/122 to engage the rod's square S may result in a rate and force of closing that allows the jaws J1/J2 to engage the square's edges and not the flats. This may be especially true if the edges are worn. If this were to occur, then rotation of the outer ring would cause the jaws J1/J2 to ratchet around the edges of the rod's square S as the jaws J1/J2 turn with the inner ring. Such an occurrence would be unacceptable and would wear down components. In the end, the jaws J1/J2 and 155 may simply rotate about the square S, opening and closing and riding the edges without making up or breaking out the connection.

Figure 21:
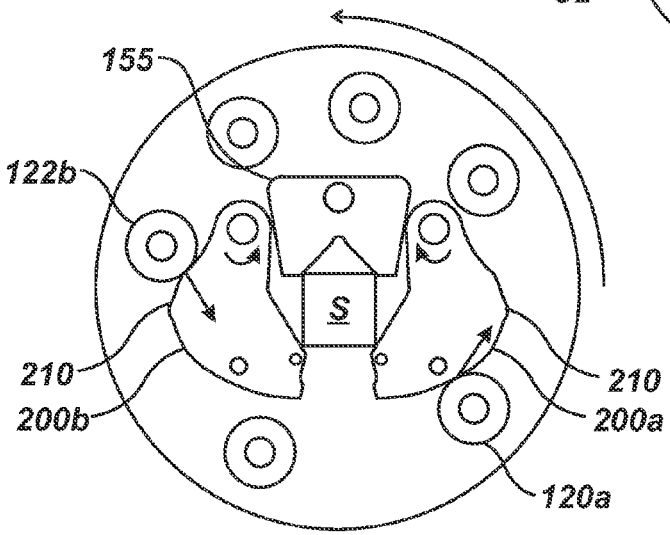
FIG. 21 shows an example of the disclosed pivoting jaws and central jaw engaging edges of the rod element square during rotation.

For this reason, the opposing jaws 200*a-b* of the present disclosure are configured with the cams 210 on the outer edges as disclosed herein. These cams 210 close the jaws' surfaces 206 around the flats of the rod's square S regardless of its orientation. As shown in FIG. 21, for example, the cams 210 close the jaws 200*a-b* against the rod element square S with a rate and force that can prevent the jaw's surfaces 206 form engaging point-to-point with the square's edges, which would cause the ratcheting problem describe previously.

Additionally, the cams 210 close the jaws 200*a-b* against the rod element square S with a rate and force that allows the rollers 120/122 engaging them to move the inner ring with the jaws 200*a-b* together an extent with the outer ring. This also can tend to help the jaws 200*a-b* engage the square's flats as well. In particular, the jaw 200*b* engaged by the back roller 122 into the rotation (shown here as counter clockwise) has force applied to the cam 210 generally aligned with the socket surface 206, which may allow the surface 206 to ride the rod's edge as the jaw 200*b* tends to pivot (counter-clockwise) and translate (counter-clockwise). On the other hand, the jaw 200*a* engaged by the front roller 120 into the rotation has force applied generally tangential to the cam surface 212, which may allow the this jaw's surface 206 to more passively engage the rod's edge as the jaw 200*a* tends to pivot (clockwise) and translate (counter-clockwise).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A rod tong assembly, comprising:

an inner ring disposed in an opening of a rod tong, the inner ring having a central jaw for engaging adjacent flats of a rod element square and having opposing jaws each for engaging another flat of the rod element square, the opposing jaws pivoting by engagement with rollers on the rod tong rotated in first and second directions about the opening, the inner ring rotating in the first and second directions by the engagement of the rollers with the jaws; and a lock disposed on the inner ring, the lock in a first condition allowing the inner ring to rotate about the opening in the first direction without the engagement of the rollers with the jaws, the lock in a second condition allowing the inner ring to rotate about the opening in the second direction without the engagement of the rollers with the jaws.

2. The assembly of claim 1, further comprising an outer ring disposed on the rod tong, the outer ring being rotatable in the first and second directions and having the opening with the rollers disposed thereabout.

3. The assembly of claim 2, further comprising:

a frame housing the outer ring; and an actuator coupled to the outer ring with gearing.

4. The assembly of claim 2, wherein the rollers comprise:

first rollers pivoting the opposing jaws against the rod element square when the rollers rotate about the opening in the first direction; and second rollers pivoting the opposing jaws against the rod element square when the rollers rotate about the opening in the second direction.

5. The assembly of claim 2, wherein the outer ring rotated in the first direction rotates relative to the inner ring to a first point of engagement between the rollers and the opposing jaws.

6. The assembly of claim 5, wherein the outer ring rotated in the first direction past the first point of engagement rotates the inner ring in the first direction.

7. The assembly of claim 5, wherein the lock in the second condition when the inner ring is rotated in the second direction away from first point of engagement rotates the inner ring in the second direction.

8. The assembly of claim 2, wherein the outer ring rotated in the second direction rotates relative to the inner ring to a second point of engagement between the rollers and the opposing jaws.

9. The assembly of claim 8, wherein the outer ring rotated in the second direction past the second point of engagement rotates the inner ring in the second direction.

10. The assembly of claim 8, wherein the lock in the first condition when the rollers are rotated in the first direction away from the second point of engagement rotates the inner ring in the first direction.

11. The assembly of claim 1, wherein each of the opposing jaws has an outside edge, the outside edge defining a first cam section for engaging one of the rollers and defining a second cam section for engaging another one of the rollers.

12. The assembly of claim 11, wherein the first and second cam sections define curvilinear surfaces on either side of a protrusion disposed on the outside edge.

13. The assembly of claim 1, wherein the central jaw defines two faces for engaging the adjacent flats of the rod element square, and wherein each of the opposing jaws defines a face for engaging another of the flats of the rod element square.

14. The assembly of claim 1, wherein the inner ring removably disposes in the opening.

15. The assembly of claim 1, wherein the lock comprises a switch rotatably disposed on the inner ring between the first and second return conditions, the switch having a first catch for engaging in the first direction and having a second catch for engaging in the second direction.

16. A rod tong assembly, comprising:

an outer ring disposed in the rod tong and being rotatable in first and second directions, the outer ring having a central opening with a plurality of rollers disposed thereabout;

an inner ring disposed in the central opening of the outer ring, the inner ring having a central jaw for engaging adjacent flats of a rod element square and having opposing jaws each for engaging another flat of the rod element square, the opposing jaws pivoting by engagement with the rollers of the outer ring rotated in the first and second directions, the inner ring rotating with the outer ring by the engagement of the rollers with the opposing jaws; and a lock disposed on the inner ring, the lock in a first condition allowing the inner ring to rotate with the outer ring in the first direction, the lock in a second condition allowing the inner ring to rotate with the outer ring in the second direction.

17. The assembly of claim 16, wherein the rollers comprise:

first rollers pivoting the opposing jaws against the rod element square when the outer ring rotates in the first direction; and second rollers pivoting the opposing jaws against the rod element square when the outer ring rotates in the second direction.

18. The assembly of claim 16, wherein the outer ring rotated in the first direction rotates relative to the inner ring to a first point of engagement between the rollers and the opposing jaws.

19. The assembly of claim 18, wherein the outer ring rotated in the first direction past the first point of engagement rotates the inner ring in the first direction.

20. The assembly of claim 18, wherein the lock in the second condition when the inner ring is rotated in the second direction away from first point of engagement rotates the inner ring in the second direction.

21. The assembly of claim 16, wherein the outer ring rotated in the second direction rotates relative to the inner ring to a second point of engagement between the rollers and the opposing jaws.

22. The assembly of claim 21, wherein the outer ring rotated in the second direction past the second point of engagement rotates the inner ring in the second direction.

23. The assembly of claim 21, wherein the lock in the first condition when the rollers are rotated in the first direction away from the second point of engagement rotates the inner ring in the first direction.

24. The assembly of claim 16, wherein each of the opposing jaws has an outside edge, the outside edge defining a first cam section for engaging one of the rollers and defining a second cam section for engaging another one of the rollers.

25. The assembly of claim 24, wherein the first and second cam sections define curvilinear surfaces on either side of a protrusion disposed on the outside edge.

26. The assembly of claim 16, wherein the central jaw defines two faces for engaging the adjacent flats of the rod element square, and wherein each of the opposing jaws defines a face for engaging another one of the flats of the rod element square.

27. The assembly of claim 16, wherein the inner ring removably disposes in the opening.

28. The assembly of claim 16, wherein the lock comprises a switch rotatably disposed on the inner ring between the first and second return conditions, the switch having a first catch for engaging a first portion of the outer ring in the first direction and having a second catch for engaging a second portion of the outer ring in the second direction.

29. The assembly of claim 16, further comprising:

a frame housing the outer ring;

a backup wrench disposed on the frame and engaging a square of another rod element; and an actuator rotating the outer ring in the first and second directions.

30. The assembly of claim 29, wherein the actuator comprises a motor coupled to the outer ring with gearing, and wherein the outer ring comprises a gear coupled to the actuator.

* * * * *